US007866014B2

(12) United States Patent
Bovard

(10) Patent No.: US 7,866,014 B2
(45) Date of Patent: Jan. 11, 2011

(54) CASKET WITH HIDDEN HINGE PROVIDING POSITION ADJUSTMENT OF CAP ON SHELL

(75) Inventor: Christopher C. Bovard, Sunman, IN (US)

(73) Assignee: Batesville Services, Inc., Batesville, IN (US)

( * ) Notice: Subject to any disclaimer, the term of this patent is extended or adjusted under 35 U.S.C. 154(b) by 269 days.

(21) Appl. No.: 12/122,679

(22) Filed: May 17, 2008

(65) Prior Publication Data

US 2009/0282658 A1 Nov. 19, 2009

(51) Int. Cl.
*A61G 17/00* (2006.01)

(52) U.S. Cl. ..... 27/18; 27/16; 16/235; 16/352

(58) Field of Classification Search ..... 27/16–18, 27/14, 2; 16/387, 348, 349, 352, 235–238, 16/242, 350, 231; 403/116; 49/394, 399
See application file for complete search history.

(56) References Cited

U.S. PATENT DOCUMENTS 1,200,477 A * 10/1916 Frantz ..... 16/348
1,994,021 A * 3/1935 Heller ..... 292/266
2,848,783 A * 8/1958 Keller, Jr. et al. ..... 27/18
3,060,546 A * 10/1962 Nelson ..... 27/18
3,959,859 A * 6/1976 Stein et al. ..... 27/18
4,062,340 A * 12/1977 Huff ..... 126/25 R
4,337,556 A 7/1982 Winburn et al.
4,337,764 A * 7/1982 Lerman ..... 602/26
4,360,953 A * 11/1982 Angermann ..... 27/14
4,524,496 A * 6/1985 Tehsildar et al. ..... 27/18
4,925,223 A * 5/1990 Craft ..... 292/339
4,980,947 A * 1/1991 McQuigge ..... 16/235
5,570,493 A * 11/1996 Gulick ..... 27/18
5,765,268 A * 6/1998 MacKirdy ..... 27/18
7,243,406 B1 7/2007 Wray
7,299,525 B2 * 11/2007 Chang ..... 16/327

* cited by examiner

*Primary Examiner*—William L. Miller
(74) *Attorney, Agent, or Firm*—Wood, Herron & Evans, LLP

(57) ABSTRACT

A casket comprises a shell, a lid closable on the shell, and a hinge mounting the lid to the shell. The hinge comprises a first hinge leaf attached to the shell, a second hinge leaf attached to the lid, a first link having a first end pivoted to the first hinge leaf, a second link having a first end fixed to the second hinge leaf, and the first and second links having respective second ends selectably fixable to one another at a plurality of positions along a length of the second link.

21 Claims, 3 Drawing Sheets

CASKET WITH HIDDEN HINGE PROVIDING POSITION ADJUSTMENT OF CAP ON SHELL

FIELD

The present invention relates generally to caskets, and more particularly to mounting hardware for mounting the cap of the casket to the shell of the casket.

BACKGROUND

Caskets have conventionally included a shell to which is mounted either a single cap or lid or a pair of caps or lids. Conventional barrel hinges have heretofore been utilized to pivotally mount lids to shells. Such a hinge has two hinge leaves having axially aligned inter-fitting hinge eyes that slidably receive a hinge pin. One leaf has through holes for receiving screws to secure it to the lid; the other leaf has through slots for receiving screws to secure it to the shell and to provide some position adjustability of it relative to the shell.

One drawback associated with the use of conventional hinges to mount lids to shells is that the aligned inter-fitting hinge eyes of the hinge leaves are visible when the lid is closed upon the shell, which detracts from the aesthetics of the casket.

Another drawback associated with the use of conventional hinges is that position adjustment of the lid fore and aft relative to the shell is cumbersome. This requires the screws attaching the hinge leaf to the shell to be loosened so that the hinge leaf can be slid fore or aft as the case may be (and as permitted by the screw slots in the hinge leaf) so as to align the lid fore and aft with the shell.

A need therefore exists for a hinge for mounting a casket cap to a casket shell which improves upon the aesthetics of hinges currently in use for same and which provides for adjustability of the cap relative to the shell without having to unscrew the hinge leaves from the shell and/or cap.

SUMMARY

In one aspect, a casket comprises a shell, a lid closable on the shell, and a hinge mounting the lid to the shell. The hinge comprises a first hinge leaf attached to the shell, a second hinge leaf attached to the lid, a first link having a first end pivoted to the first hinge leaf, a second link having a first end fixed to the second hinge leaf, and the first and second links having respective second ends selectably fixable to one another at a plurality of positions along a length of the second link.

The first hinge leaf can have a hinge eye and the first end of the first link can have a through hole. The hinge can further have a hinge pin passing through the hinge eye and the first link through hole. The second link can have a plurality of through holes along the length of the second link, and the hinge can further include a pair of fasteners fastening the second end of the first link to the second link through two of the holes. The first link can have a yoke at the second end of the first link that receives the second link, the pair of fasteners passing through the yoke and the two holes in the second link. The first hinge leaf can have a slot therein generally perpendicular to a pivot axis of the first link to provide clearance for the first link during closing of the lid on the shell. The surface of the shell to which the first hinge leaf is attached, and the surface of the lid to which the second hinge leaf is attached, can be generally perpendicular when the lid is closed on the shell, and can be generally parallel when the lid is open. The surface of the shell to which the first hinge leaf is attached can be an upwardly facing flange of the shell, and the surface of the lid to which the second hinge leaf is attached can be a surface which is generally perpendicular to a downwardly facing flange of the lid.

A hinge for attaching a casket lid to a casket shell is also provided.

DRAWINGS

DESCRIPTION

Figure 1:
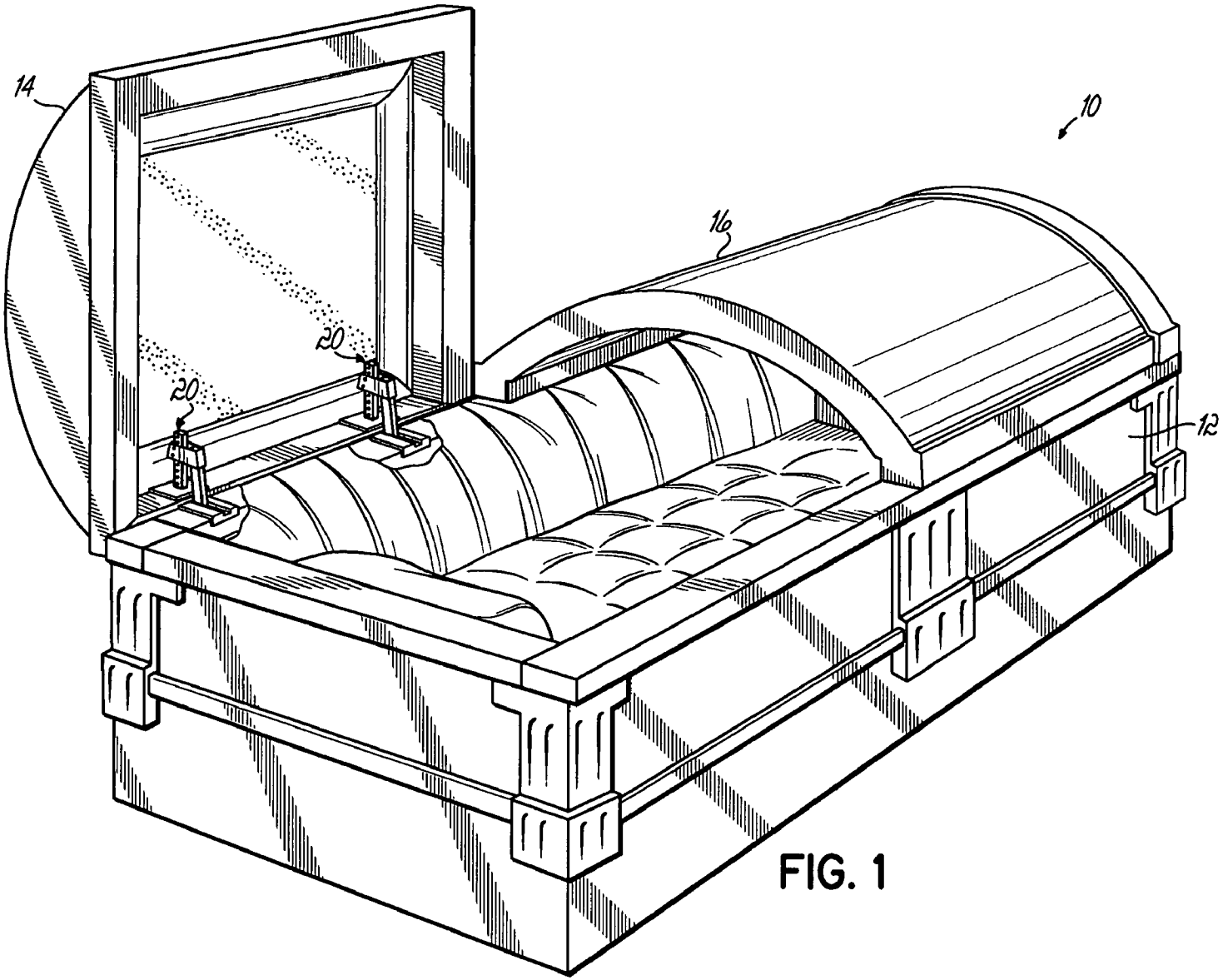
FIG. 1 is a perspective view of a casket incorporating the hinge of this disclosure.
Figure 2:
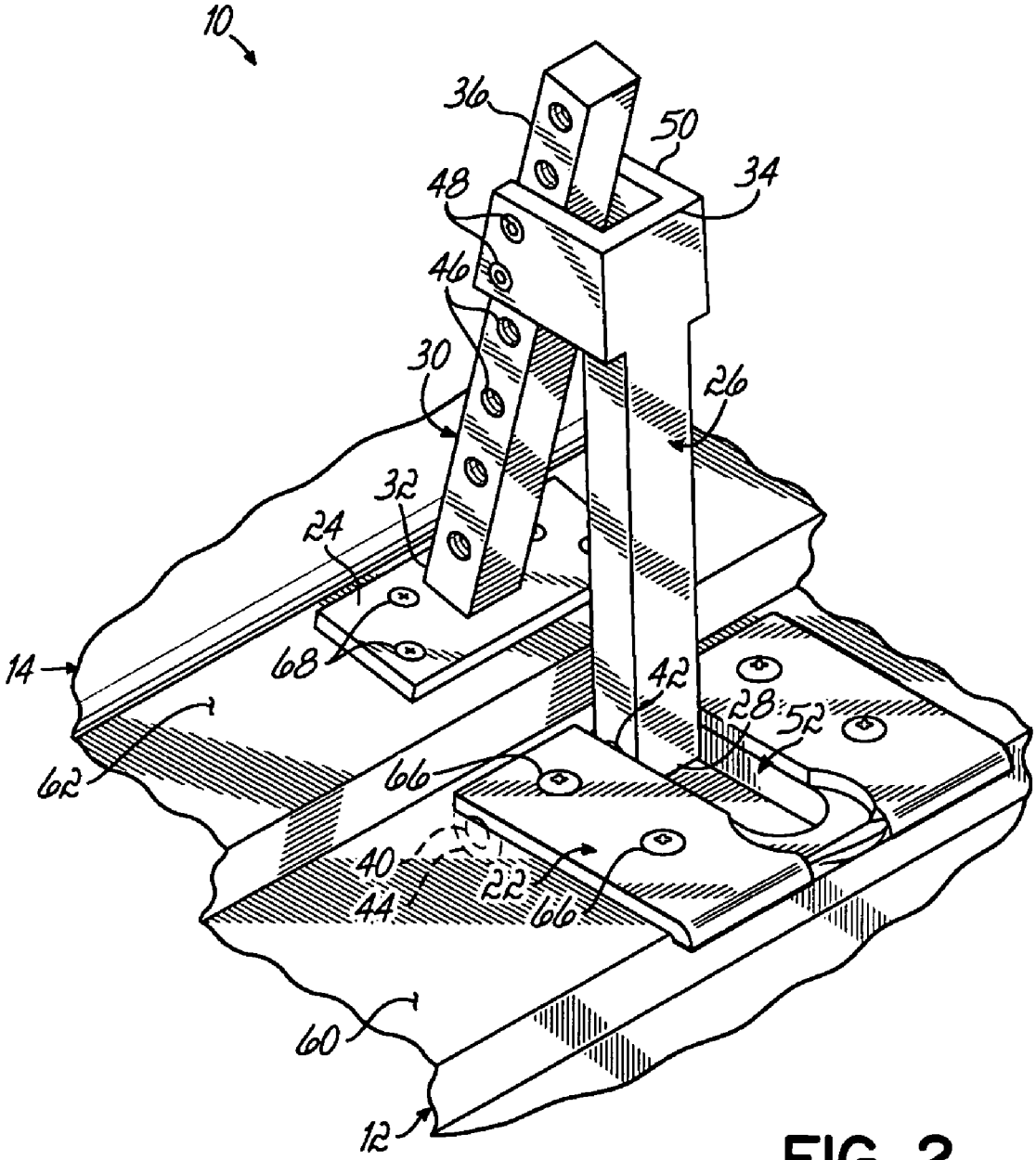
FIG. 2 is an enlarged perspective view of the hinge of FIG. 1.

Referring to FIG. 1, a casket 10 has a shell 12, a head end cap or lid 14 and a foot end cap or lid 16. Casket 10 could just as well have a single cap or lid; such a casket is sometimes referred to as a "full couch" casket. The casket 10 illustrated in FIG. 1 is sometimes referred to as a "split top" or "split cap" casket. Both types of caskets are embraced by the claims.

A hinge 20 mounts the lid 14 to the shell 12. (A like hinge 20 can mount the lid 16 to the shell 12 but only the mounting of the head end lid 14 to the shell 12 will be discussed herein.) The hinge 20 comprises a first hinge leaf 22 attached to the shell 12 and a second hinge leaf 24 attached to the lid 14. A first link 26 has a first end 28 pivoted to the first hinge leaf 22. A second link 30 has a first end 32 fixed to the second hinge leaf 24. The first 26 and second 30 links have respective second ends 34, 36 selectably fixable to one another at a plurality of positions along a length of the second link 30.

More particularly, the first hinge leaf 22 can have a hinge eye 40 and the first end 28 of the first link 26 can have a through hole 42. The hinge 20 can further have a hinge pin 44 passing through the hinge eye 40 and the through hole 42 of the first link 26 to thereby provide the pivot connection of first link 26 to first hinge leaf 22. The second link 30 can have a plurality of through holes 46 along the length of the second link 30. A pair of fasteners 48, 48, e.g. screws, bolts, pins, etc., can fasten the second end 34 of the first link 26 to the second link 30 through two of the holes 48. The first link 26 can have a yoke 50 at the second end 34 of the first link 26 that receives the second link 30, the pair of fasteners 48, 48 passing through the yoke 50 and the two holes 48, 48 in the second link 30. The first hinge leaf 22 can have a slot 52 therein generally perpendicular to a pivot axis of the first link 26 to provide clearance for the first link 26 during closing of the lid 14 on the shell 12.

Figure 3:
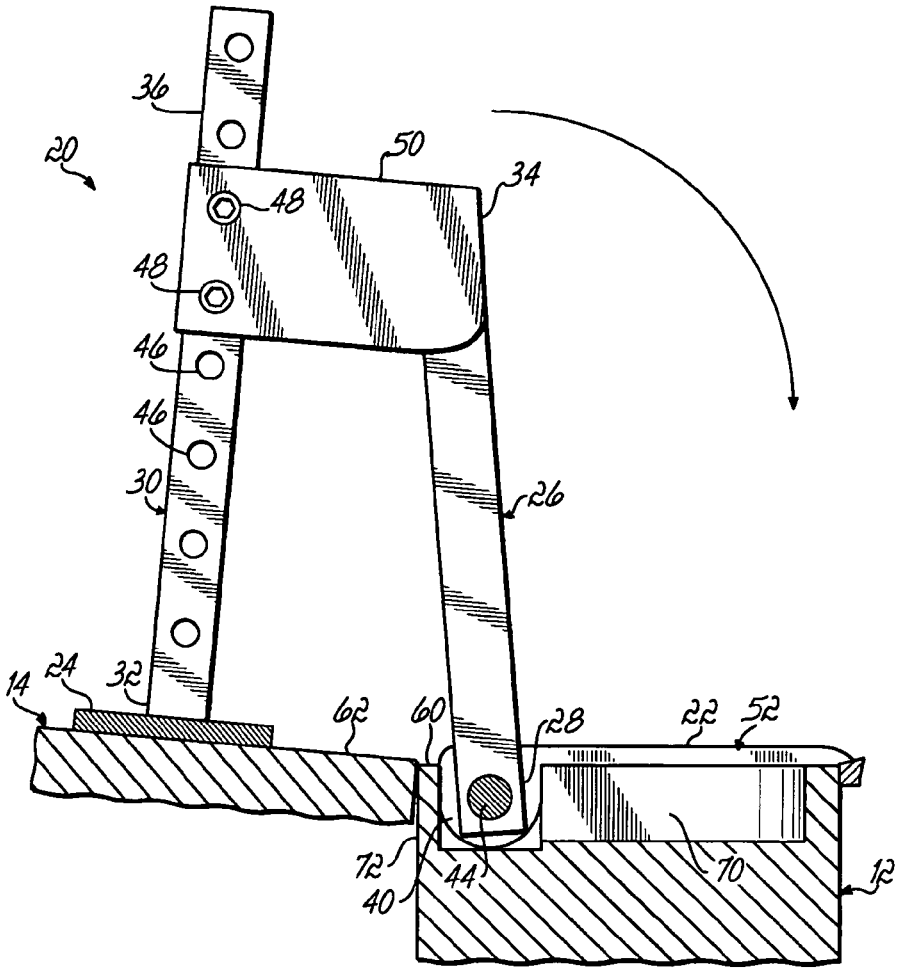
FIG. 3 is a side view of the hinge of FIGS. 1 and 2 shown with the lid in the open position.
Figure 4:
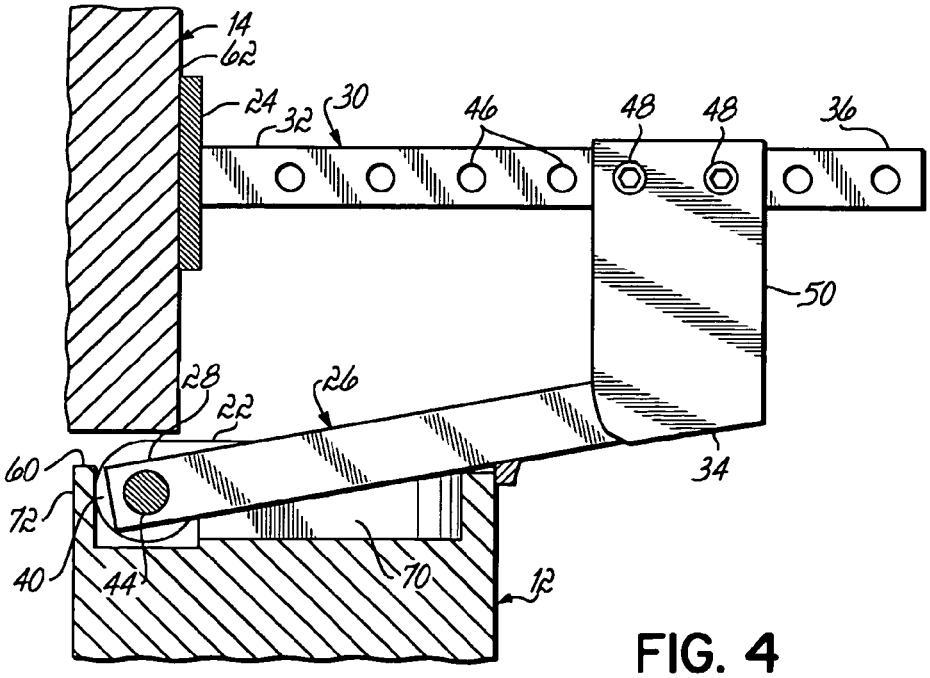
FIG. 4 is a view similar to FIG. 3 with the lid shown in the closed position.

As shown in FIGS. 3 and 4, the surface of the shell 12 to which the first hinge leaf 22 is attached, and the surface of the lid 14 to which the second hinge leaf 24 is attached, can be generally perpendicular when the lid 14 is closed on the shell 12, and can be generally parallel when the lid 14 is open. More particularly, the surface of the shell 12 to which the first hinge leaf 22 is attached can be an upwardly facing flange 60 of the shell 12, and the surface of the lid 14 to which the second hinge leaf 24 is attached can be a surface 62 which is generally perpendicular to a downwardly facing flange 64 of the lid 14 (i.e. downwardly facing when the lid 14 is closed). Conventional fasteners, such as screws 66, 68, can be used to attach the first hinge leaf 22 to the shell 12 and the second hinge leaf 24 to the lid 14, respectively. Flange 60 of shell 12 can be relieved as at 70 to accommodate hinge eye 40 of hinge leaf 24. By beginning relief 70 just forward of rear edge 72 of shell flange 60, hinge eye 40 and hence hinge 20 is not visible to onlookers viewing casket 10 from the rear.

By varying the position of attachment of the link 30 to the yoke 50, along the length of link 30, one is able to adjust fore and aft the position of the lid 14 on the shell 12 when the lid 14 is in the closed position. Fasteners 48, 48 are removed from the yoke 50 and one set of holes 46, 46, and are replaced in the yoke 50 and another set of holes 48, 48 to accomplish adjustment. Screws 66, 68 fastening hinge leaves 22, 24 to the shell 12 and lid 14, respectively do not have to be loosened or removed.

The embodiments shown and described are for illustrative purposes only. The drawings and the description are not intended to limit in any way the scope of the claims. Those skilled in the art will appreciate various changes, modifications, and alternative embodiments. For example, the first hinge leaf 22 with the pivoting link 26 could be attached to the lid 14 and the second hinge leaf 24 with the fixed link 30 could be attached to the shell 12. All such changes, modifications and embodiments are embraced by the claims. Accordingly, the scope of the right to exclude shall be limited only by the following claims and their equivalents.

What is claimed is:

1. A casket comprising:

a shell, a lid closable on said shell, and a hinge mounting said lid to said shell, said hinge comprising:

a first hinge leaf attached to said shell, a second hinge leaf attached to said lid, a first link having a first end pivoted to said first hinge leaf, a second link having a first end nonrotatably fixed to said second hinge leaf, and said first link having a second end selectably fixable with a fastening structure to said second link at a plurality of positions along a length of said second link.

2. The casket of claim 1 wherein said first hinge leaf has a hinge eye and said first end of said first link has a through hole, said hinge further having a hinge pin passing through said hinge eye and said first link through hole.

3. The casket of claim 1 wherein a surface of said shell to which said first hinge leaf is attached, and a surface of said lid to which said second hinge leaf is attached, are generally perpendicular when said lid is closed on said shell, and are generally parallel when said lid is open.

4. The casket of claim 3 wherein said surface of said shell to which said first hinge leaf is attached is an upwardly facing flange of said shell, and said surface of said lid to which said second hinge leaf is attached is a surface which is generally perpendicular to a downwardly facing flange of said lid.

5. A casket comprising:

a shell, a lid closable on said shell, and a hinge mounting said lid to said shell, said hinge comprising:

a first hinge leaf attached to said shell, a second hinge leaf attached to said lid, a first link having a first end pivoted to said first hinge leaf, a second link having a first end fixed to said second hinge leaf, and said first and second links having respective second ends selectably fixable to one another at a plurality of positions along a length of said second link, wherein said first hinge leaf has a hinge eye and said first end of said first link has a through hole, said hinge further having a hinge pin passing through said hinge eye and said first link through hole, wherein said second link has a plurality of through holes along said length of said second link, said hinge further including a pair of fasteners fastening said second end of said first link to said second link through two of said holes.

6. The casket of claim 5 wherein said first link has a yoke at said second end of said first link which receives said second link, said pair of fasteners passing through said yoke and said two holes in said second link.

7. The casket of claim 6 wherein said first hinge leaf has a slot therein generally perpendicular to a pivot axis of said first link to provide clearance for said first link during closing of said lid on said shell.

8. A hinge for attaching a casket lid to a casket shell, said hinge comprising:

a first hinge leaf adapted to be attached to one of said shell and said lid, a second hinge leaf adapted to be attached to the other of said shell and said lid, a first link having a first end pivoted to said first hinge leaf, a second link having a first end nonrotatably fixed to said second hinge leaf, and said first link having a second end selectably fixable with a fastening structure to said second link at a plurality of positions along a length of said second link.

9. The hinge of claim 8 wherein said first hinge leaf has a hinge eye and said first end of said first link has a through hole, said hinge further having a hinge pin passing through said hinge eye and said first link through hole.

10. The hinge of claim 8 wherein a surface of the one of the shell and the lid to which said first hinge leaf is adapted to be attached, and a surface of the other of the shell and the lid to which said second hinge leaf is adapted to be attached, are generally perpendicular when the lid is closed on the shell, and are generally parallel when the lid is open.

11. The hinge of claim 10 wherein the surface of the shell is an upwardly facing flange of the shell, and the surface of the lid is a surface which is generally perpendicular to a downwardly facing flange of the lid.

12. A hinge for attaching a casket lid to a casket shell, said hinge comprising:

a first hinge leaf adapted to be attached to one of said shell and said lid, a second hinge leaf adapted to be attached to the other of said shell and said lid, a first link having a first end pivoted to said first hinge leaf, a second link having a first end fixed to said second hinge leaf, and said first and second links having respective second ends selectably fixable to one another at a plurality of positions along a length of said second link, wherein said first hinge leaf has a hinge eye and said first end of said first link has a through hole, said hinge further having a hinge pin passing through said hinge eye and said first link through hole, wherein said second link has a plurality of through holes along said length of said second link, said hinge further including a pair of fasteners fastening said second end of said first link to said second link through two of said holes.

13. The hinge of claim 12 wherein said first link has a yoke at said second end of said first link which receives said second link, said pair of fasteners passing through said yoke and said two holes in said second link.

14. The hinge of claim 13 wherein said first hinge leaf has a slot therein generally perpendicular to a pivot axis of said first link to provide clearance for said first link during closing of the lid on the shell.

15. A casket comprising:

a shell, a lid closable on said shell, and a hinge mounting said lid to said shell, said hinge comprising:

a first hinge leaf attached to one of said shell and said lid, a second hinge leaf attached to the other of said shell and said lid, a first link having a first end pivoted to said first hinge leaf, a second link having a first end nonrotatably fixed to said second hinge leaf, and said first link having a second end selectably fixable with a fastening structure to said second link at a plurality of positions along a length of said second link.

16. The casket of claim 15 wherein said first hinge leaf has a hinge eye and said first end of said first link has a through hole, said hinge further having a hinge pin passing through said hinge eye and said first link through hole.

17. The casket of claim 15 wherein a surface of said one of said shell and said lid to which said first hinge leaf is attached, and a surface of said other of said shell and said lid to which said second hinge leaf is attached, are generally perpendicular when said lid is closed on said shell, and are generally parallel when said lid is open.

18. The casket of claim 17 wherein said surface of said shell is an upwardly facing flange of said shell, and said surface of said lid is a surface which is generally perpendicular to a downwardly facing flange of said lid.

19. A casket comprising:

a shell, a lid closable on said shell, and a hinge mounting said lid to said shell, said hinge comprising:

a first hinge leaf attached to one of said shell and said lid, a second hinge leaf attached to the other of said shell and said lid, a first link having a first end pivoted to said first hinge leaf, a second link having a first end fixed to said second hinge leaf, and said first and second links having respective second ends selectably fixable to one another at a plurality of positions along a length of said second link, wherein said first hinge leaf has a hinge eye and said first end of said first link has a through hole, said hinge further having a hinge pin passing through said hinge eye and said first link through hole, wherein said second link has a plurality of through holes along said length of said second link, said hinge further including a pair of fasteners fastening said second end of said first link to said second link through two of said holes.

20. The casket of claim 19 wherein said first link has a yoke at said second end of said first link which receives said second link, said pair of fasteners passing through said yoke and said two holes in said second link.

21. The casket of claim 20 wherein said first hinge leaf has a slot therein generally perpendicular to a pivot axis of said first link to provide clearance for said first link during closing of said lid on said shell.

* * * * *